US005209381A

United States Patent [19]

Jay

[11] Patent Number: 5,209,381

[45] Date of Patent: May 11, 1993

[54] BACKPACK CONVERTIBLE CHAIR

[76] Inventor: John C. Jay, 18 Sea St., Manchester, Mass. 01944

[21] Appl. No.: 702,233

[22] Filed: May 17, 1991

Related U.S. Application Data

[63] Continuation-in-part of Ser. No. 482,637, Feb. 21, 1990, Pat. No. 5,016,792.

[51] Int. Cl.[5] ..... A45F 4/02; A45F 4/06

[52] U.S. Cl. ..... 224/155; 224/156

[58] Field of Search ..... 224/155, 153, 156; 297/183, 229, 17, 129

[56] References Cited

U.S. PATENT DOCUMENTS

| | | | |
|---|---|---|---|
| 2,490,367 | 12/1949 | Maddock | 190/8 |
| 2,819,776 | 1/1958 | Balsam | 190/1 |
| 2,843,185 | 7/1958 | Clem et al. | 224/155 |
| 2,915,154 | 12/1959 | Holder | 190/8 |
| 2,973,888 | 3/1961 | Beardsley | 224/155 |
| 3,266,686 | 8/1966 | Griffith | 224/9 |
| 3,307,758 | 3/1967 | Platt | 224/9 |
| 3,309,134 | 3/1967 | Roberts | 297/17 |
| 3,404,915 | 10/1968 | Filho | 297/17 |
| 3,662,932 | 5/1972 | Kerschner | 224/9 |
| 3,828,992 | 8/1974 | Cerchione | 224/156 |
| 3,947,903 | 4/1976 | Menke | 5/111 |
| 4,286,739 | 9/1981 | Silcott et al. | 224/156 |
| 4,300,707 | 11/1981 | Kjaer | 224/155 |
| 4,487,345 | 12/1984 | Pierce et al. | 224/155 |
| 4,518,198 | 5/1985 | Daniels | 297/229 |
| 4,530,451 | 7/1985 | Hamilton | 224/155 |
| 4,577,901 | 3/1986 | Phillips | 297/17 |
| 4,676,548 | 6/1987 | Bradbury | 297/129 |
| 4,687,248 | 8/1987 | Ross et al. | 297/17 |
| 4,773,574 | 8/1988 | Burgard | 224/155 |
| 4,773,708 | 9/1988 | Nastu | 297/17 |
| 4,885,812 | 12/1989 | Linder | 224/156 |
| 4,947,498 | 8/1990 | Van Boxtel | 224/155 |
| 4,955,517 | 9/1990 | Maresca | 224/156 |

FOREIGN PATENT DOCUMENTS

| | | | |
|---|---|---|---|
| 2825366 | 12/1979 | Fed. Rep. of Germany | 224/155 |

*Primary Examiner*—Henry J. Recla
*Assistant Examiner*—David J. Walczak
*Attorney, Agent, or Firm*—Wolf, Greenfield & Sacks

[57] ABSTRACT

A convertible backpack assembly for carrying items therewithin, yet provide a readily adaptable assembly for conversion to a beach type chair. The assembly includes a frame base and forward and rearward frame portions each attached to the frame base by a ratchet arrangement. A pair of leg members extend downwardly from the frame base. The forwardmost leg member is pivotally attached to the frame base so as to be swingable away from the lower back of the carrier of the convertible backpack assembly. Webbing material is be disposed over the frame portions and across the frame base, to define the front and back of the backpack as well as the back, seat and leg support portions of the chair. The seat portion may have its tension adjusted under the frame base, to allow greatest sitter comfort. A pair of side panels of webbing material are removably disposed between the front and rear frame portions to define the sides of the backpack assembly. The side panels may either attach to the sides of webbing material over the front and back frame portions or form part of a separate liner that functions as the container for the backpack between the front and back frame portions.

18 Claims, 7 Drawing Sheets

Fig. 3
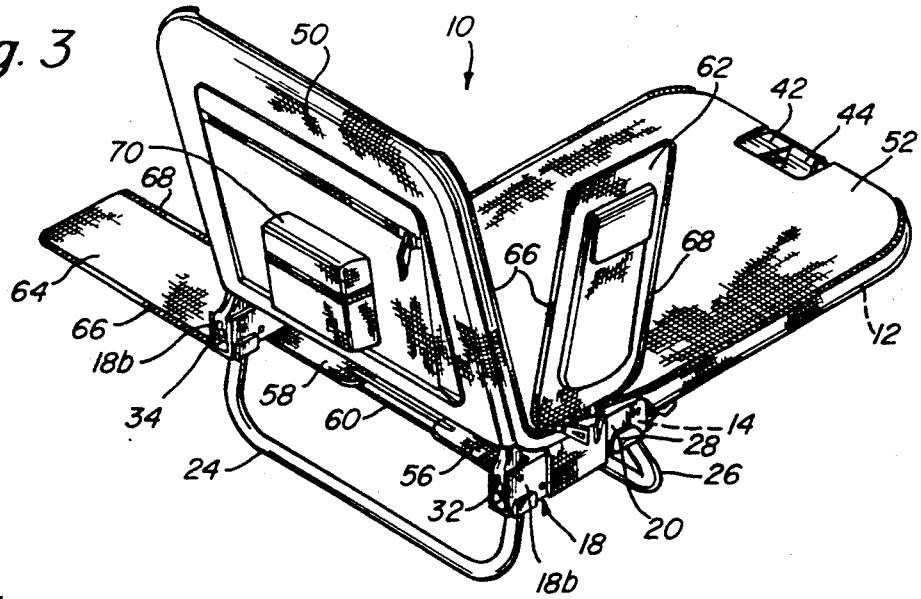
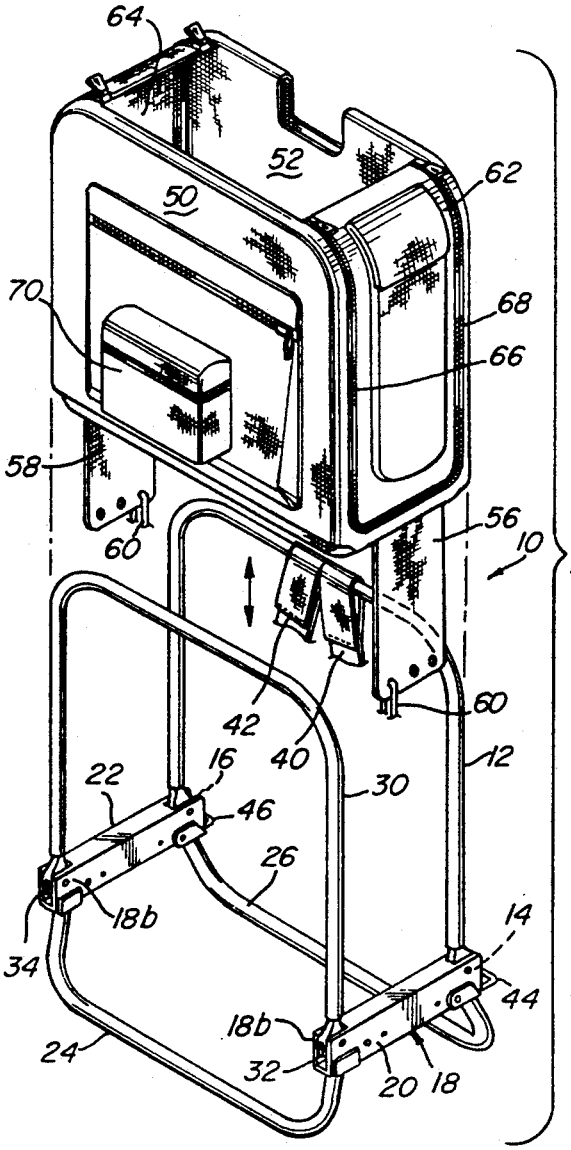
Fig. 4
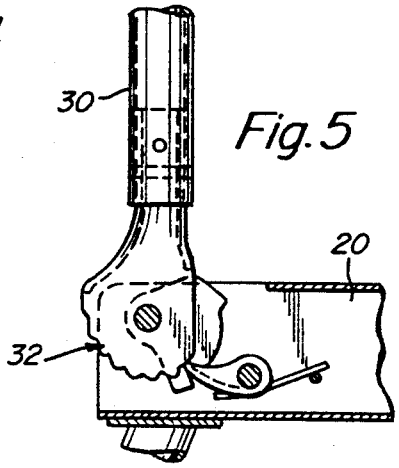
Fig. 5

BACKPACK CONVERTIBLE CHAIR

RELATED PRIOR APPLICATION

This application is a continuation in part of my copending application Ser. No. 07/482,637, now U.S. Pat. No. 5,016,792 filed Feb. 21, 1990 entitled Backpack Convertible Chair.

BACKGROUND OF THE INVENTION

Field of the Invention

This invention relates to backpacks having a substantial load carrying capacity, and more particularly, to a backpack which readily converts into a chair.

INTRODUCTION

"Backpack" is defined as a camping pack usually made of canvas or nylon supported by a light metal frame and carried on the back. Backpacks normally have a carrying capacity of approximately forty pounds or more as distinct from knapsacks and tote bags that normally have a capacity in the range of ten pounds. The present invention is both a backpack and a folding chair and performs both functions with equal facility.

An essential characteristic of an acceptable backpack is that it be comfortable when carried on the back even with a full load of forty pounds or more. It must be free of rigid frame members that can rub against or dig into the back of the carrier, and it must be properly balanced so as not to sag to the side or rearwardly away for the carrier's back. Furthermore, it must be convenient to use. The backpack of the present invention has all of those required characteristics. In addition, the backpack of this invention may easily and conveniently be converted to a comfortable chair when the main contents of the pack are removed. This combination is not found in the prior art.

U.S. Pat. No. 4,687,248 discloses a tote bag that may be converted to a lounge chair. As a tote bag its capacity is in the ten pound range rather than that of a backpack. As a tote bag it is provided with handles which enable the bag to be hand carried and the device also has a single shoulder strap for alternatively carrying the tote bag on one side at waist height. The article is not a backpack nor does it have the capacity of one.

U.S. Pat. No. 4,676,584 discloses a foldable beach type chair that can be carried on the back by means of its shoulder straps, and the chair in turn has an external pack attached to it. The rigid chair frame bears against the back and clearly would be uncomfortable when the device is carried on the back.

U.S. Pat. No. 2,490,367 shows a folding chair that may be collapsed and carried by handles which are attached to it, and the sides of the seat and back may be attached so that the collapsed chair may serve as a hold all. The device has limited carrying capacity as it has no depth and could not comfortably be carried on the back.

U.S. Pat. No. 4,773,547 discloses a foldable backpack like frame that may be opened to form a small bench type seat. The frame in turn has a separate carrying bag. This frame would be uncomfortable in the region of the lower back of the carrier as it has a rigid frame member that extends across the lower portion of the torso when the device is placed on the back and supported by shoulder straps.

U.S. Pat. No. 4,530,451 also discloses a storage bag attached to a foldable chair frame and is uncomfortable for the same reasons as the structure of the '547 patent. Another pack is shown in U.S. Pat. No. 3,266,686, which utilizes chains and pivotable links to create a chair from a backpack frame. U.S. Pat. No. 4,487,345 shows yet another folding (typically wood frame) chair with a container attached to its back. This device would also be uncomfortable when carried on the back because of the rigid frame.

U.S. Pat. No. 4,577,901 discloses a folding chair with carrier straps, and a cushioning pad to minimize discomfort to the lower back of the person carrying the chair. It obviously lacks the carrying capacity of a backpack.

U.S. Pat. No. 3,307,758 shows a bag and backrest combination which includes ropes to hold the seat and back together in proper supporting position. It is not a chair and it does not support the occupant off the ground. U.S. Pat. No. 3,662,932 discloses a box like pack which converts to a stool. The frame includes components that unscrew from the pack and reattach to provide legs for the stool. The rigid frame members would be uncomfortable when carried on the back. U.S. Pat. No. 4,286,739 discloses a backpack frame which when unfolded, makes up to a chair. The bag portion hangs from side rails of the pack and does not form part of the seat support. Separate straps are provided for that purpose.

The present invention, overcomes the limitations of the prior art and provides a convenient and comfortable backpack with substantial capacity and which readily converts into a comfortable chair.

BRIEF SUMMARY OF THE INVENTION

The present invention provides a backpack, capable of carrying large loads in a frame protected configuration, which frame is comfortable and adjustable for its carrier, and which backpack is readily convertible to an adjustable chair.

The backpack frame includes first and second frame portions which are pivotally attached to a frame base that includes a pair of side rails. The attachments are made through ratchet devices. The first and second frame portions are separately enclosed in canvas webbing envelopes that serve as the back and leg rest when the device is in the chair configuration.

A forward leg member is pivotally secured to and extends downwardly from the frame base. When the device is in the backpack configuration the forward leg is pivoted to a position away from the carrier's back. A rearward leg member is also connected to and extends downwardly from the frame base and the two leg members comprise the chair legs.

When the first and second frame portions are generally parallel to one another and approximately perpendicular to the side rails of the frame base, the device is in the backpack configuration. The forward leg member may be pivoted rearwardly away from the carrier's back so as not to hit against his/her lower back or buttocks when the backpack is carried on the back. A pair of side panels are fixed to the side rails and are releasably attached to the sides of the first and second frame portions when the device is in the backpack configuration. A cover flap is attached to the free end of one of the frame portions away from the ratchet devices and preferably may be connected in different positions to the other frame portion, depending upon whether it simply is to close the backpack as defined by the two frame portions, frame base and side panels or to both close the backpack and retain a sleeping bag or other equipment on the pack. The assembly is also provided with a number of auxiliary pockets as well as a pair of shoulder carrying straps to enable the backpack to be carried on the back of the user.

In one embodiment of this invention, the side panels of the pack are permanently secured at their bottom edges to the canvas webbing of the front and back portions of the pack while the side edges of the side panels are detachable from the edges of the webbing. In a second embodiment the side panels are part of a separate liner that serves as a removable container for the backpack. In this embodiment the liner with its side panels is removable intact from between the front and rear portions of the pack.

In converting the backpack to a beach chair, the side panels of the backpack are detached (unzipped) along their side edges from the webbing envelopes of the first and second frame portions. The side panels are then folded under the bottom of the frame base, and are attached to one another. The first and second frame portions may then be ratcheted away from one another to form the back and leg rest portions of the chair. In converting from a chair to a backpack configuration, the foregoing steps are reversed.

BRIEF DESCRIPTION OF THE DRAWINGS

The advantages of the present invention will become more apparent when viewed in conjunction with the following drawings, in which:

FIG. 3 is a perspective view of the present invention in one of it chair configurations and showing the way the side panels are detached from the frame members;

FIG. 4 is an exploded perspective view of the frame and canvas webbing in the backpack configuration;

FIG. 5 is a side elevational view of one of the ratchet mechanisms of the present invention;

DESCRIPTION OF THE PREFERRED EMBODIMENT

Figure 1:
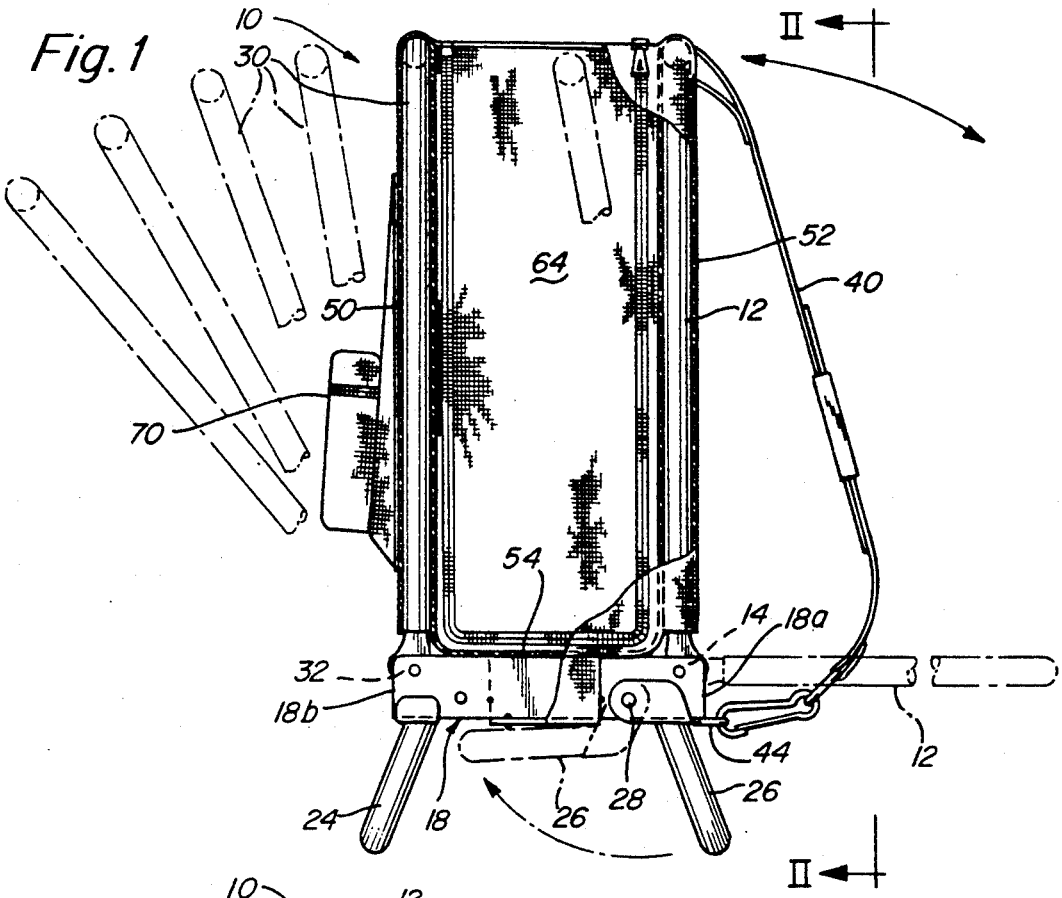
FIG. 1 is a side elevational view of the present invention in its backpack configuration.
Figure 2:
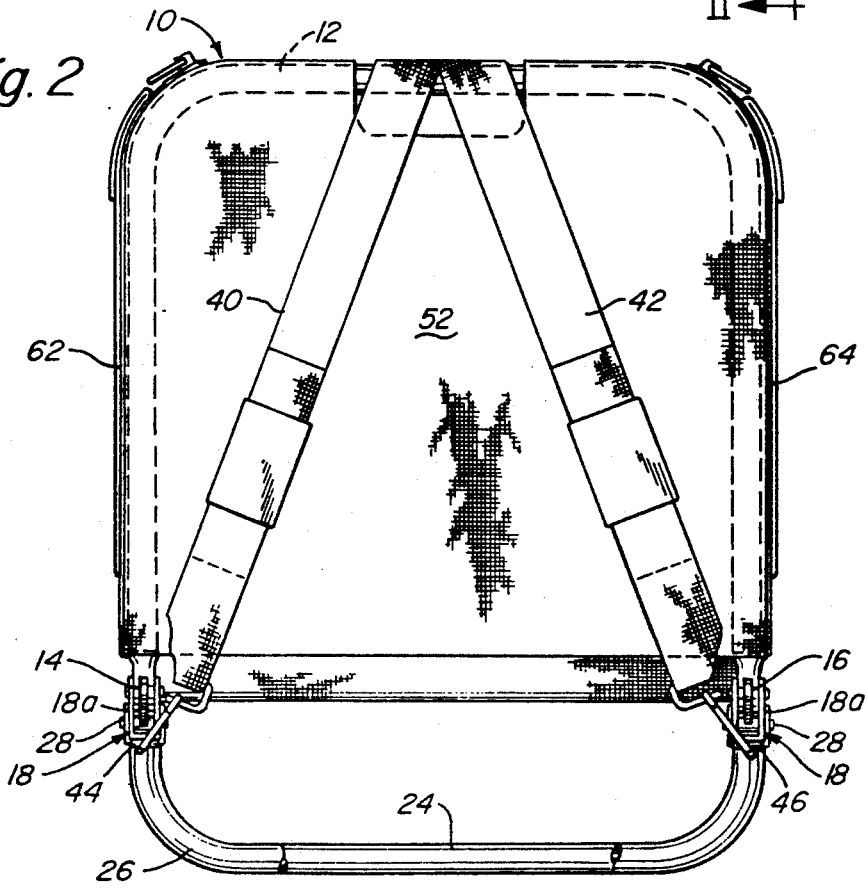
FIG. 2 is a view taken along the lines II—II if FIG. 1.
Figure 6:
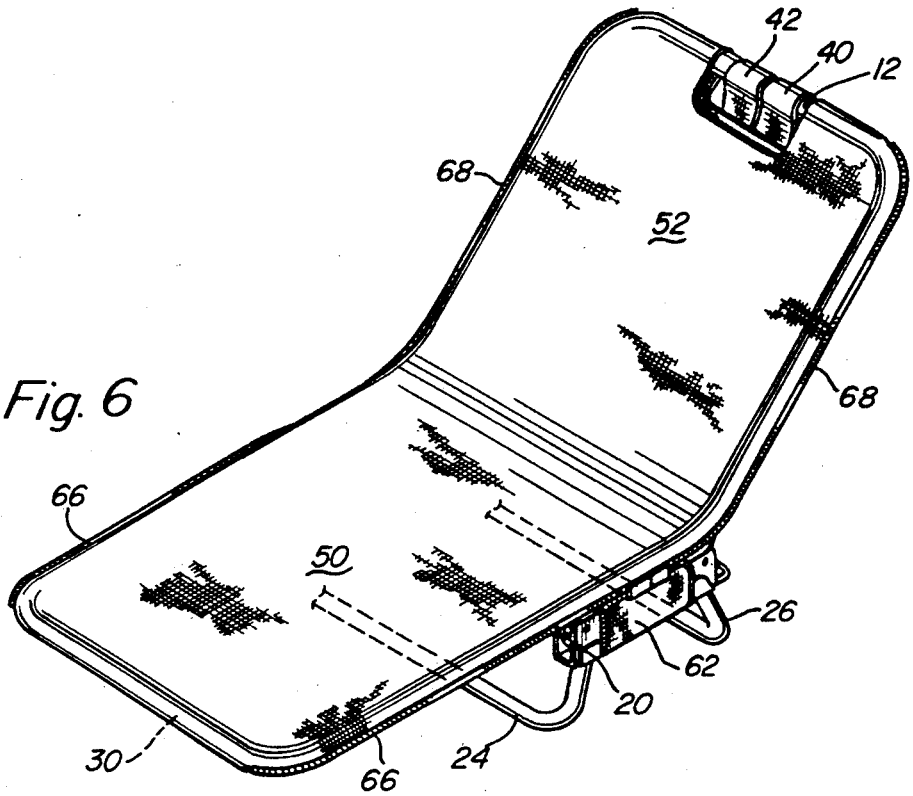
FIG. 6 is a perspective view of the invention as a chair in one of its reclining open configurations and with the side panels stored beneath the seat or base member of the device.

Referring to the drawings now in detail, and particularly to FIGS. 1 and 2 there is shown a convertible backpack assembly 10 in its backpack configuration. The convertible backpack assembly 10 includes a forward or first frame portion 12 of generally inverted U shape, manufactured preferably from tubular aluminum or steel. The first frame portion 12 is articulably secured by a pair of ratchet members 14 and 16 preferably made from steel, to a frame base 18, which comprises a pair of transversely adjacent parallel rails 20 and 22. The rails 20 and 22 of frame base 18 have forward and rearward ends 18*a* and 18*b* respectively. A slightly angularly rearwardly disposed U shaped rear leg member 24 is fixedly secured to the rearward end 18*b* of each rail 20 and 22, as shown in FIGS. 1, 3 and 4. The side view of FIG. 1 shows in phantom lines how the forward leg member 26 may be swung rearwardly on its hinge devices 28, so as to be held under the frame base 18, and out of the way when desired.

A rearward or second frame portion 30 of generally inverted U shaped configuration, as best shown in FIGS. 1 and 4 is articulably secured by a pair of ratchet members 32 and 34, to the frame base 18. The second frame portion 30 is similar to first frame portion 12, except that the two are arranged to pivot apart (away) from one another, as may be seen in FIGS. 1 and 3.

A pair of adjustable shoulder carrying straps 40 and 42 are each secured to the upper portion of the first frame member 12, and to lower loops 44 and 46 at the forward end 18*a* of each of the parallel side rails 20 and 22.

A back canvas web envelope 50 is disposed about the second frame portion 30, and a front canvas web envelope 52 is disposed about the first frame portion 12, as shown in FIGS. 3 and 4. A bottom panel of canvas webbing 54 is connected between the front and back canvas web envelopes 52 and 50, as shown in FIG. 1. A pair of bottom flaps 56 and 58 extend from the sides of the bottom panel canvas webbing 54, as shown in FIGS. 3 and 4. The bottom flaps 56 and 58 are adapted to wrap around the outside portions of the parallel side rails 20 and 22 which comprise the frame base 18. Each bottom flap 56 and 58 has a securement means 60 such as a tie cord so as to adjustably tighten and tension the bottom panel canvas web 54 to the frame base 18.

A pair of elongated canvas side panels 62 and 64 are attached to the bottom panel canvas webbing 54, as also shown in FIGS. 3 and 4. Securing means 66 and 68 such as zippers extend along the long edges of each side panel 62 and 64, and the sides of each canvas web envelope 50 and 52. When the side panels 62 and 64 are zippered to the canvas web envelopes 50 and 52 as best shown in FIGS. 4 and 7, they define the side wall portions of the backpack, in which goods may be carried by an individual.

Figure 7:
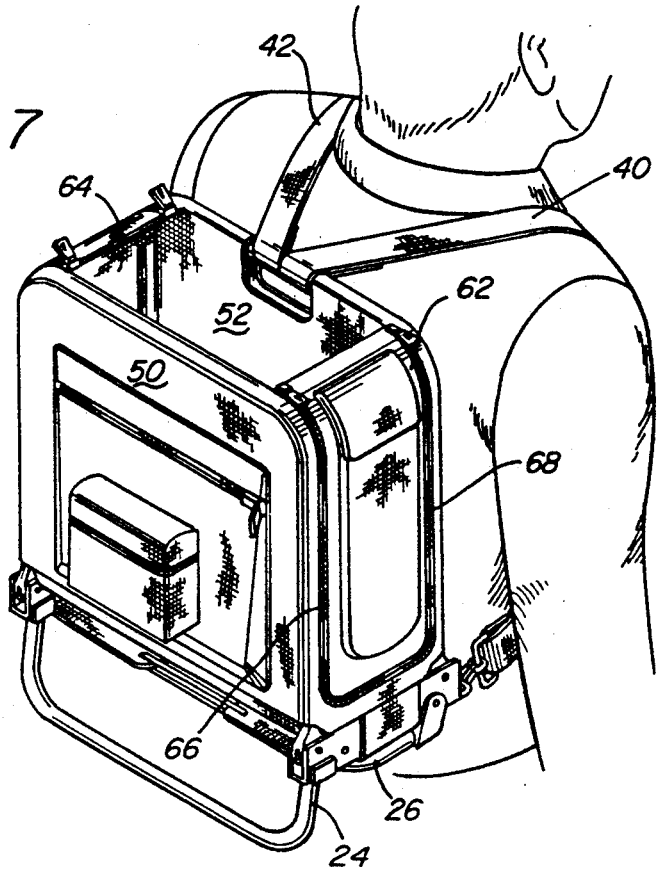
FIG. 7 is a perspective view of the invention in its cargo carrying configuration, being on the back of a person.

When the convertible backpack assembly 10 is being utilized as a backpack, the forward leg member 26 is pivoted rearwardly as shown in phantom in FIGS. 1 and 7 so as to be out of the way and not pressing or rubbing against or digging into the wearer's (carrier's) lower back.

When it is desired to utilize the convertible backpack assembly 10 as a chair, the forward leg member is arranged in its downward orientation, as shown in FIGS. 1, 3, 4 and 6. The contents of the backpack assembly 10 are removed, and the side panels 62 and 64 are unzipped. For this purpose a bag shaped liner may be provided in the backpack into which the contents of the pack may be placed, and the liner may be pulled from the pack to remove the contents as a unit when the device is to be made up as a chair. Each side panel 62 and 64 may have securing means so as to permit them to wrap securely under the bottom flaps 56 and 58 and attach to one another.

The first frame portion 12 with its canvas web envelope 52 may be rocked to disengage its ratchet members 14 and 16, and then rotated into its generally horizontal leg supporting orientation, as shown in FIG. 3, although it may also be disposed at a non horizontal orientation. The second frame portion 30 with its canvas web envelope 50 may similarly be pivoted to be inclined at an obtuse angle with respect to the frame base 18, and serve as the back of the chair assembly. The bottom panel 54 comprises the chair seat. Actually, either canvas web 50 or 52 may comprise the back of the chair and the remaining one, the leg support. The opposing frame portions 12 and 30 are thus able to move from the parallel relationship shown in FIGS. 1, 4 and 7, through a ratching range into which they can become generally coplanar.

An additional pocket 70 may be arranged on the back portion of the canvas web envelope 50 for further storage capabilities. A hood may be secured to the distal edge 72 of the canvas web envelope 52 on the first frame portion 12, so as to provide a closure for the backpack. The web need not be of canvas, but may be comprised of any flexible, durable material. Additionally, the web may be easily removed and replaced from the frame by merely untying the cord 60 which holds the webs 56 and 58 tautly together, sliding the front and back canvas web envelopes 50 and 52 from the frames 12 and 30, and dropping a new web envelope arrangement onto those frames 12 and 30, and merely securing it under the frame 18, by retying the cords 60 between the new flaps 56 and 58.

Figure 8:
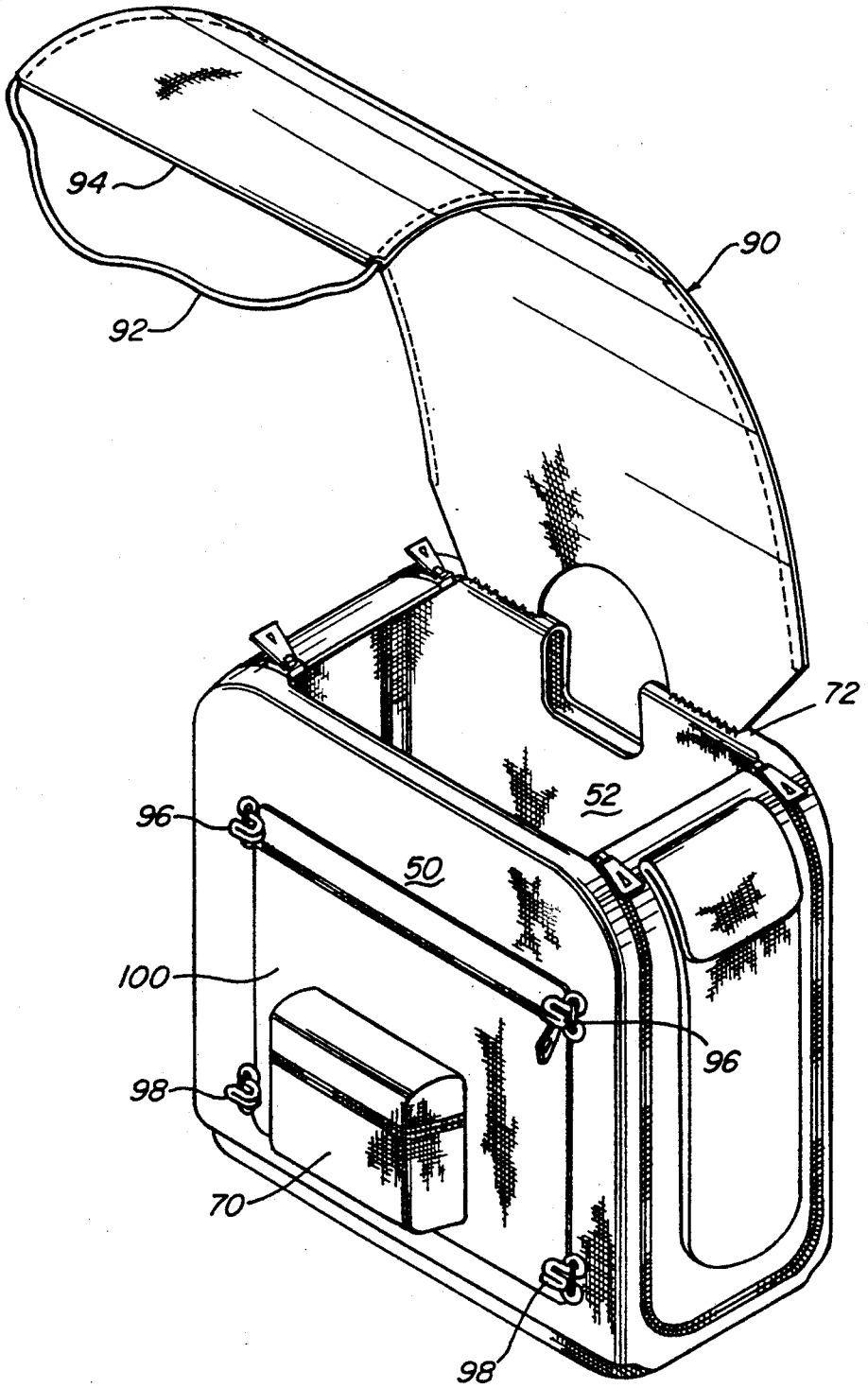
FIG. 8 is a perspective view of the device in the backpack configuration but with the frame omitted and showing a cover panel attached to it.
Figure 9:
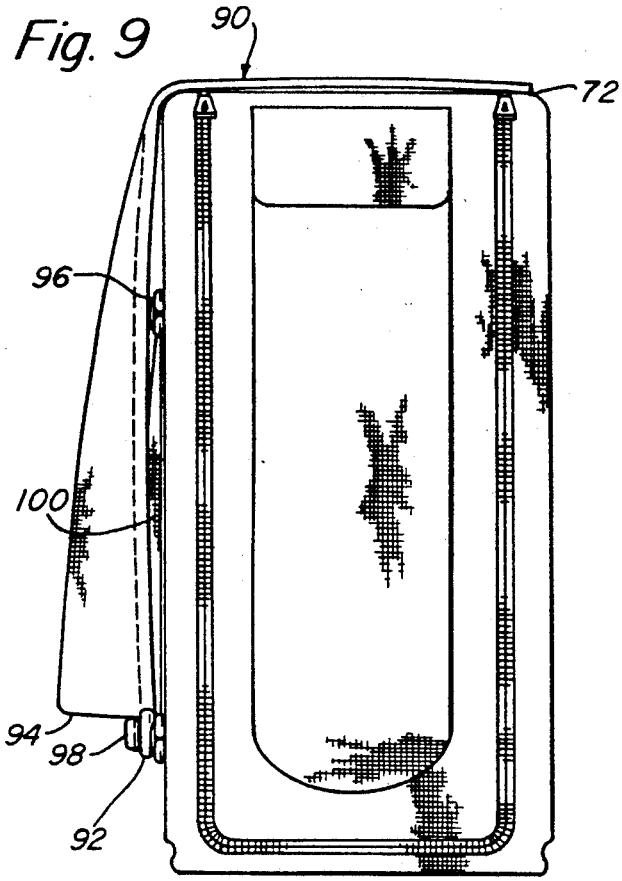
FIG. 9 is a side view of the assembly of FIG. 8 and showing one position for the cover panel.
Figure 10:
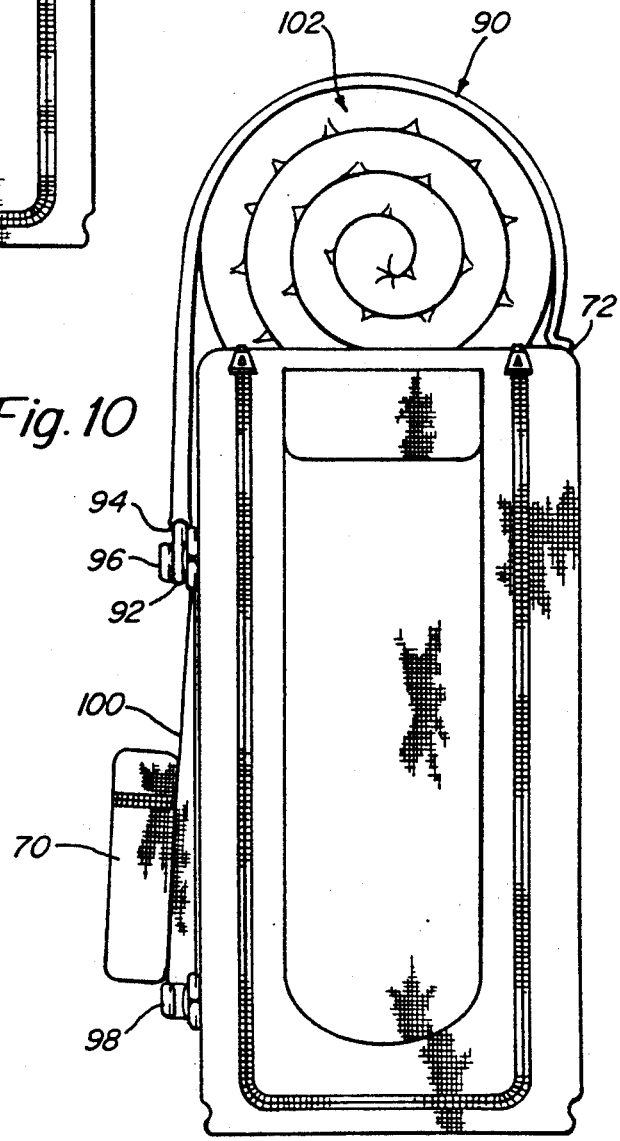
FIG. 10 is a side view similar to FIG. 9 but showing a second position for the cover panel as it may be used to carry a sleeping bag.

In FIGS. 8–10 a cover 90 is shown stitched to the upper edge 72 of the canvas envelope 52. The cover 90 carries a cord 92 at its free end 94 for securing the cover to the canvas envelope 50 on the rear frame member 30. For that purpose, two pairs of hooks 96, 96 and 98, 98 are secured to the panel 100 at the corners of the pocket 70. In FIG. 9 the cover 90 is shown secured by the cord 92 to the hooks 98, 98 so that the cover extends closely over the top of the backpack. The long length of the cover 90 permits it to be used to carry equipment on top of the backpack by securing the band 92 to the hooks 96, 96. This arrangement is shown in FIG. 10. It will be noted in that figure that a roll 102 that may represent a sleeping bag, bed roll, or some similar camping equipment, is shown disposed on the top of the backpack, and the cover 90 extends over it and is secured by the cord 92 to the hooks 96, 96. Thus, the cover 90 may serve simply as a cover for the backpack to close the container portion thereof, or it may be used as an additional carrier to attach equipment to the top of the pack. To provide additional flexibility in the use of the cover, the cord may be elasticized. When the assembly is used as a chair, the cover 90 may be folded under the leg supporting portion of the chair or it may form an extension thereof for the feet.

Figure 11:
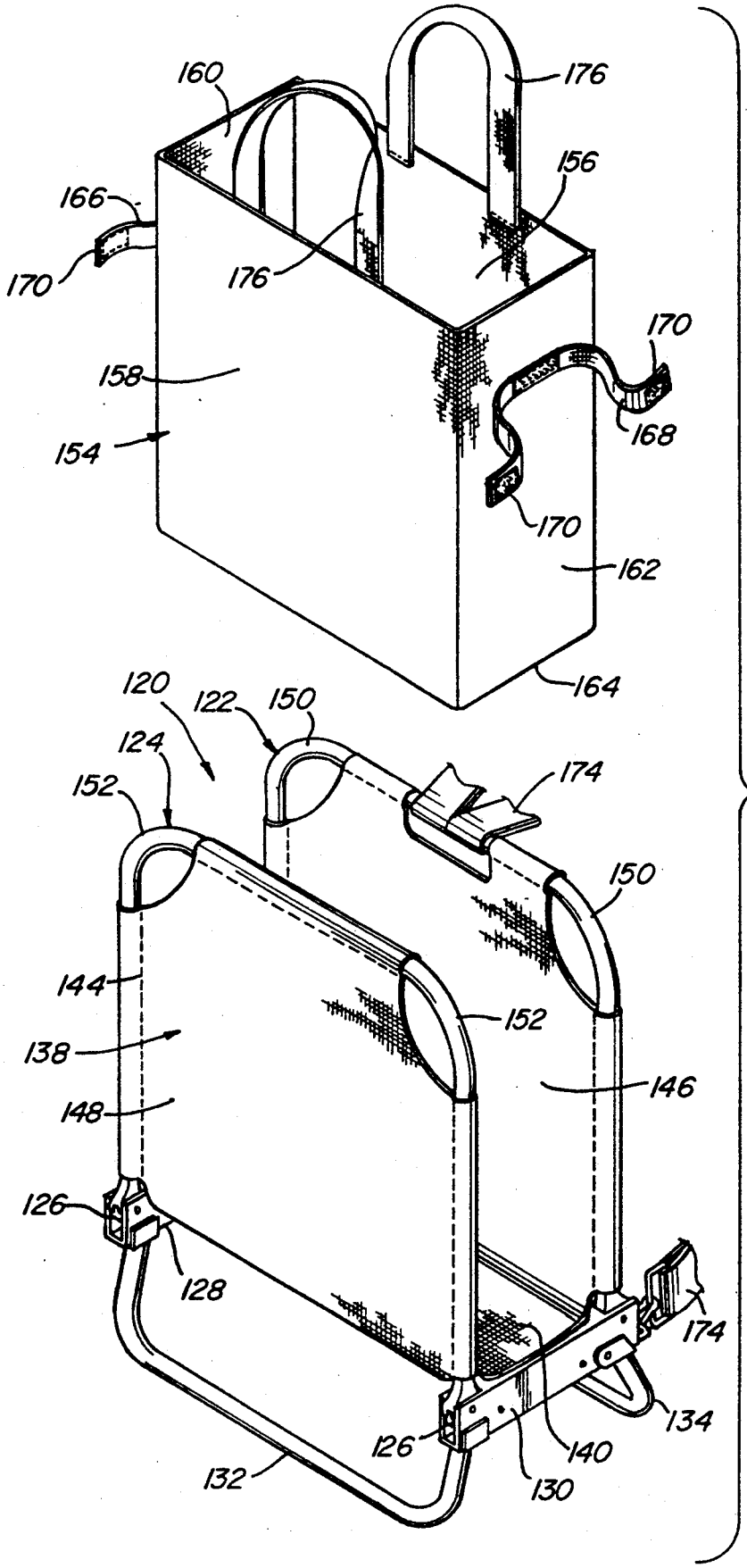
FIG. 11 is an exploded perspective view of a second embodiment of this invention.
Figure 12:
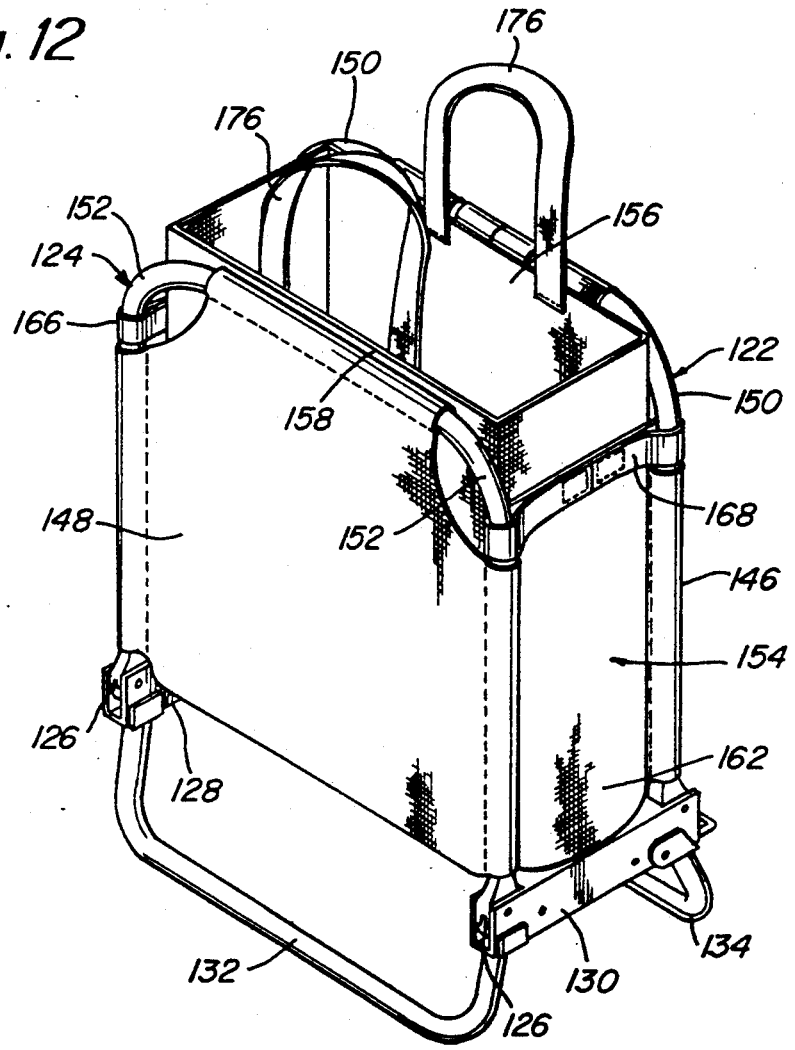
FIG. 12 is a perspective view of the embodiment of FIG. 11 in its assembled form.

In FIGS. 11 and 12 a second embodiment of the combination backpack and chair is shown which is somewhat less expensive to manufacture than the embodiment of FIGS. 1–10. The unit is built about a metal frame 120 that may be identical to the fame of the first embodiment and therefore need not be described in detail. Briefly, it includes front and rear U-shaped tubular members 122 and 124 that are attached by ratchet mechanisms 126 to the side rails 128 and 130. The frame also includes front and rear leg members 132 and 134, and the front leg member 134 is pivotally supported so that it may be swung away from the back of the person carrying the backpack just as front leg member 26 in the first embodiment.

In FIGS. 11 and 12 one sheet of canvas webbing 138 is secured to the front and rear U shaped members 122 and 124 to form the front and back walls of the backpack, and the central portion 140 of the webbing extends between the two frame members to form the bottom wall of the pack and the seat of the chair in the backpack and chair configurations, respectively. In this embodiment a single ply sheet of webbing may be used with flaps along the sides stitched or otherwise secured about the tubular portions of the frame as suggested by the broken lines 144 which may represent stitching. For example zippers may be used rather than stitching so as to enable the webbing to be removed for washing etc.

The webbing 138 when mounted on the frame forms front and rear panels 146 and 148 along with the bottom panel 140.

It will be noted in the drawing that the corners 150 of the front frame member 122 and the corners 152 of the rear frame member 124 are exposed. The exposed corners of the tubular members are utilized to mount an inner container 154 in place between the panels 146 and 148 as is explained in greater detail below. The container 154 made of flexible material such as canvas that may be identical to the webbing 138 is of conventional shape having front and rear panels 156 and 158, side panels 160 and 162 and bottom panel 164. The container 154 is sized to fit between the panels 146 and 148 of the backpack with its side panels 160 and 162 essentially aligned with the parallel sides of the front and rear frame members 122 and 124. This relationship is shown in FIG. 12. Heavy horizontal straps 166 and 168 are stitched to the upper portions of the side panels 160 and 162, respectively of the container 154. The ends of the straps 166 and 168 in use are threaded about the exposed portions of the frames at the corners 150 and 152 so as to releasably secure the container 154 in place. Preferably the straps 166 and 168 are secured by Velcro-type fasteners (mating hook and loop fabric) on the inner faces of the straps. One convenient arrangement for that purpose is to line the inner faces of the straps with the hook fasteners of the Velcro material and provide patches of looped fabric at the ends of the straps as suggested at 170. That arrangement enables the straps 166 and 168 to be looped around the exposed portions of the frame 120 at the corners 150 and 152 and be secured firmly in place as shown in FIG. 12.

With the container 154 mounted in place as shown in FIG. 12, together with the metal frame 120 and the canvas sheet 138 it forms the body of the backpack and shoulder straps 174 secured to the frame as suggested in FIG. 11 and in the same manner as in the first embodiment enable the backpack to be carried comfortably in precisely the same fashion as the backpack of FIGS. 1–10. As a backpack it has a large carrying capacity of approximately forty pounds or more. When the assembly is used as a chair, the straps 166 and 168 are opened by releasing the Velcro type fasteners, and the container 154 may be conveniently lifted from between the panels 146 and 148 by the handles 176 so as to remove the contents of the backpack. When the container 154 is removed, the front and rear frame members 122 and 124 may be pivoted by means of the ratchet mechanisms 126 that join the members to the side rails 128 and 130 to form the assembly into the chair configuration. The container 154 thus serves not only as a liner for the backpack but actually forms part of the main backpack structure as well. It is evident in FIG. 12 that the side panels 160 and 162 of the container 154 actually define the side panels of the assembled backpack. As in the first embodiment a cover (not shown) is secured to the top of one of the panels 146 and 148 and fastens to the other to close the pack and preferably enable gear to be carried on the top of the pack. Alternatively, the cover may be mounted on the container 154.

In each of the two embodiments there has been shown a novel framework which when fitted with sheaths or pockets and panels of web material, may be articulated from a backpack configuration to a multi position chair which permits comfortable carrying as a backpack. As is illustrated in the drawings, in each embodiment the bottom panel that serves as the bottom wall of the backpack and the seat of the chair has a depth measured between the front and back panels that is approximately half the height of those panels measured from the top bars to the bottoms of the side bars. This relationship creates a pack that has the usual carrying capacity of a backpack and is comfortable when worn as it does not extend too far behind the carrier, and also provides a comfortable support when in the chair configuration.

It will be evident to those skilled in the art that numerous modifications of the structure may be made without departing from the spirit of this invention. Therefore it is not intended that the scope of this invention be limited to the specific embodiments shown and described. Rather, its scope is to be determined by the appended claims and their equivalents.

I claim:

1. A backpack assembly which is convertible to a multiposition chair comprising:

front and rear backpack sections that are essentially the same size and each including an inverted U-shaped frame lying in a common plane and having a rigid, top horizontal cross bar with a central portion and a pair of rigid, parallel side bars with top ends connected to and extending downwardly from the ends of the top bar, said U-shaped frame being free of any direct rigid connections between the lower ends of the bars in the common plane, said front and rear sections being substantially parallel and coextensive with one another when the assembly is in the backpack configuration, flexible front and back panels that are part of the front and back sections and carried by each of the two U-shaped frames and respectively essentially filling the area described by the cross bar and side bars of each frame, a first rail made of rigid material pivotally connected at its ends to the lower ends of one side bar of each U-shaped frame and a second rail parallel to the first rail and also made of rigid material and pivotally connected at its ends to the lower ends of the other side bars of the frames, each of said U-shaped frames being pivotable to an obtuse angle to the rails about axes defined by the pivotal connections of the U-shaped frames to the rails when the assembly is in a chair configuration so as to serve as a backrest and leg rest for the chair, a flexible bottom panel connected to the front and back panels and extending between the two rails and forming a bottom wall for the assembly when the assembly is in the backpack configuration and forming a seat for the chair when the assembly is in the chair configuration, said bottom panel measured from the front to the back panel being approximately half the length of the back and front panels measured from the top bars to the bottom ends of the side bars, side panels detachably connected to the edges of the front and rear sections adjacent the side bars, said side panels forming the sides of the backpack in the backpack configuration and being detached from the front and rear sections in the chair configuration, and backpack straps connected to the central portion of the top cross bar of the front section and the rails.

2. A backpack assembly as defined in claim 1 wherein leg members are connected to the rails for supporting the bottom panel off the ground when the assembly is in the chair configuration.

3. A backpack assembly as defined in claim 2 wherein one of said leg members is pivotally connected to the ends of the rails disposed closer to the back of a person carrying the assembly when the assembly is in the configuration of a backpack, said leg being pivotable on the rails away from the back of the carrier.

4. A backpack assembly as defined in claim 1 wherein adjusting means are secured to the bottom panel for regulating the tension therein.

5. A backpack assembly having a large carrying chamber with a capacity of approximately 40 pounds or more and which is convertible to a multiposition chair comprising, a base frame having parallel rigid side rails with front ends and back ends, said side rails defining a bottom plane, a pair of inverted U-shaped frame members of substantially the same size and each having top horizontal bars and vertical side bars, pivoting and locking means interconnecting the lower ends of the side bars of one member to the front ends of the side rails and the lower ends of side bars of the other member to the rear ends of the side rails enabling each of the members to be releasably locked in a plurality of selected positions forming right and obtuse angles with the plane of the side rails about axes defined by the pivotal connections of the side bars to the rails, said frame members being at right angles to the side rails in the backpack configuration and at obtuse angles thereto in the chair configuration, flexible material secured to each of the U-shaped members and extending between the side rails forming front, back and bottom panels for the backpack and serving as backrest, leg rest and seat respectively when the assembly is in the chair configuration, said bottom panel measured from front to back panel being approximately half of the height of the front and back panels, said front and back panels further having top and bottom edges, front and rear leg members secured to the rails for supporting the bottom panel above the ground when the assembly is in the chair configuration, side panels detachably secured between the side bars and defining part of the carrying chamber of the backpack when attached between the side bars, said panels being detached from between the side bars when the assembly is in the chair configuration, and backpack shoulder straps operatively connected to the top bar and the lower ends of the side bars of one of the U-shaped members for attaching the backpack on the back of a carrier.

6. A backpack assembly as defined in claim 5 wherein the side panels are permanently connected to the bottom panel.

7. A backpack assembly as defined in claim 6 wherein the side panels are detachably connected to the front and back panels.

8. A backpack assembly as defined in claim 5 wherein the side panels form part of a flexible container disposed between the front and rear panels.

9. A backpack assembly as defined in claim 8 wherein the container has front and rear walls connected to said side panels.

10. A backpack assembly as defined in claim 56 wherein said front leg member is pivotally attached to the rails so as to be disposed adjacent to the bottom panel when the assembly is in the backpack configuration.

11. A backpack assembly as defined in claim 5 wherein said front leg member is pivotally attached to the rails and is free of any rigid parts extending between the side rails in the plane of said one of the U-shaped members when the assembly is in the backpack configuration.

12. A backpack assembly as defined in claim 5 wherein the U-shaped frame member to which the shoulder straps are connected is free of any rigid connection between the side bars in the plane of that U-shaped frame member.

13. A backpack assembly as defined in claim 5 wherein a cover for the backpack is attached to the top edge of the front panel and extends over the top edge of the back pane.

14. A backpack assembly as defined in claim 13 wherein means are provided on the back panel for selectively attaching the cover to the back panel in alternative positions to vary the capacity of the backpack.

15. A backpack assembly as defined in claim 1 wherein a cover has one edge attached to the top of the front section and extends over the top of the back section and over at least a portion of back panel.

16. A backpack assembly as defined in claim 15 wherein the cover has a free end opposite the edge attached to the top of the front section and means are provided on the back face of the back section for selectively attaching the free end to increase or limit the capacity of the backpack.

17. A backpack assembly as defined in claim 1 wherein the front and back panels include fabric envelopes that enclose the frames in both the front and back sections.

18. A backpack assembly as defined in claim 17 wherein the bottom panel is a fabric and is attached to the fabric envelopes of the front and back panels.

* * * * *